US011351565B2

(12) United States Patent
Carter

(10) Patent No.: US 11,351,565 B2
(45) Date of Patent: Jun. 7, 2022

(54) INTAKE BOOT FOR HOUSEHOLD PUMP DISPENSER SUPPLY TUBE

(71) Applicant: J2 Innovations LLC, Evanston, WY (US)

(72) Inventor: Joseph Simpson Carter, Evanston, WY (US)

( * ) Notice: Subject to any disclaimer, the term of this patent is extended or adjusted under 35 U.S.C. 154(b) by 0 days.

(21) Appl. No.: 17/167,786

(22) Filed: Feb. 4, 2021

(65) Prior Publication Data

US 2021/0268530 A1 Sep. 2, 2021

Related U.S. Application Data

(60) Provisional application No. 62/983,454, filed on Feb. 28, 2020.

(51) Int. Cl.
*B05B 15/30* (2018.01)
*B05B 11/00* (2006.01)

(52) U.S. Cl.
CPC ..... *B05B 15/30* (2018.02); *B05B 11/0059* (2013.01); *B05B 11/3001* (2013.01)

(58) Field of Classification Search
CPC ..... B23K 20/122; B05B 11/0059; B05B 11/3001; B05B 15/30
See application file for complete search history.

(56) References Cited

U.S. PATENT DOCUMENTS 56,004 A 7/1866 Canewell
152,332 A 6/1874 Chamberlain
378,886 A * 3/1888 Hoy ..... B05B 11/0059 222/376
2,483,661 A 10/1949 Neas
2,556,180 A 6/1951 Hamilton et al.
2,950,031 A * 8/1960 Abplanalp ..... B65D 83/32 222/402.1
4,830,235 A 5/1989 Miller
5,527,577 A 6/1996 Walters et al.
6,264,073 B1 * 7/2001 Good ..... B05B 11/0059 222/464.4
9,604,238 B2 3/2017 Geldard
2006/0108379 A1 * 5/2006 Glynn ..... G01F 11/288 222/211
2007/0062517 A1 * 3/2007 Barker ..... A61M 11/007 128/200.14
2008/0023499 A1 * 1/2008 Knight ..... B05B 11/0037 222/464.7
2010/0140303 A1 6/2010 Baglin
2010/0155430 A1 6/2010 Schwandt
2013/0327428 A1 * 12/2013 Siddhamalli ..... B32B 1/08 137/565.01

(Continued)

FOREIGN PATENT DOCUMENTS

DE 10347466 B4 * 10/2005 ..... B05B 11/0059
FR 2804414 A1 * 8/2001 ..... B05B 11/0059

(Continued)

*Primary Examiner* — Vishal Pancholi
*Assistant Examiner* — Bob Zadeh
(74) *Attorney, Agent, or Firm* — Pate Peterson PLLC; Brett Peterson

(57) ABSTRACT

An intake boot for pump dispensers is provided. The intake boot is reliably positioned into a lower corner of a bottle and allows toiletry products such as lotions or creams to be easily dispensed from the pump dispenser until the bottle is empty.

20 Claims, 8 Drawing Sheets

(56) References Cited

U.S. PATENT DOCUMENTS

| | | | | |
|---|---|---|---|---|
| 2015/0343471 | A1* | 12/2015 | Kim | B05B 15/30<br>222/464.2 |
| 2017/0100735 | A1* | 4/2017 | Taylor | B05B 11/3045 |
| 2019/0111449 | A1 | 4/2019 | Mengisteab | |
| 2021/0268530 | A1* | 9/2021 | Carter | B05B 15/30 |

FOREIGN PATENT DOCUMENTS

| | | | | |
|---|---|---|---|---|
| GB | 191324774 A | * | 11/1914 | B05B 15/30 |
| JP | H10165853 | | 12/1996 | |
| JP | 2004130263 | * | 4/2004 | |
| KR | 200393640 | * | 8/2005 | B65D 51/1611 |

* cited by examiner

INTAKE BOOT FOR HOUSEHOLD PUMP DISPENSER SUPPLY TUBE

PRIORITY

The present application claims the benefit of U.S. Provisional Application Ser. No. 62/983,454, filed Feb. 28, 2020, which is herein incorporated by reference in its entirety.

THE FIELD OF THE INVENTION

The present invention relates to pump dispensers for household products. In particular, examples of the present invention relate to an intake boot which may be applied to the intake tube of pump dispensers to aid in dispensing viscous fluids such as lotions and creams.

BACKGROUND

Many toiletries such as lotions or creams are non-Newtonian fluids. These fluids do not dispense well from pump dispensers when the dispenser bottle is nearing empty. In many instances, a significant amount of product remains in the dispenser bottle when the pump begins to draw air from the container. For more expensive designer toiletries, the amount of product left in the bottle when it becomes difficult to dispense the product can be a significant cost.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1:
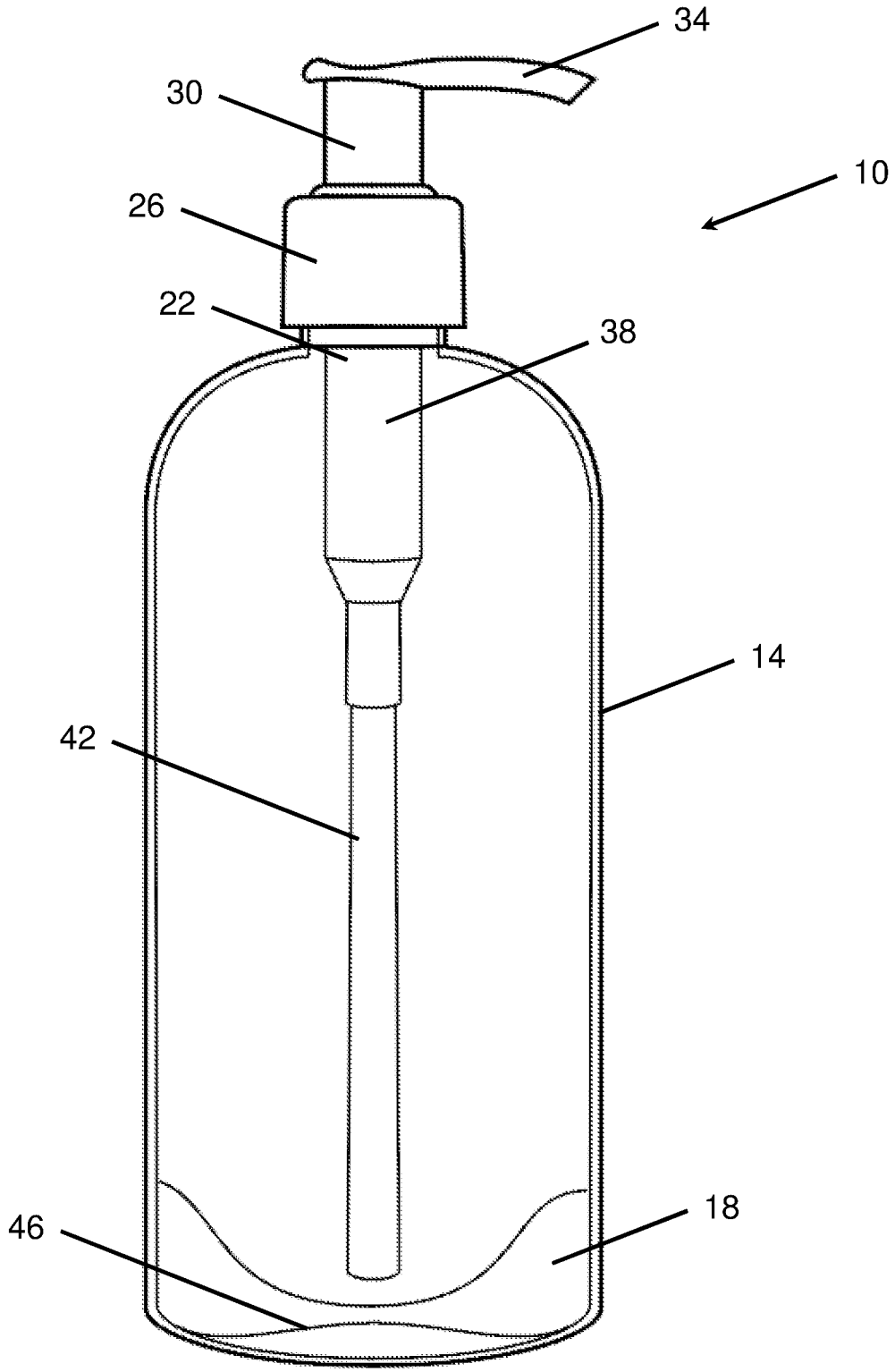
FIG. 1 is a drawing of a bottle and dispenser pump used for toiletries.

Corresponding reference characters indicate corresponding components throughout the several views of the drawings. Unless otherwise noted, the drawings have been drawn to scale. Skilled artisans will appreciate that elements in the figures are illustrated for simplicity and clarity. For example, the dimensions of some of the elements in the figures may be exaggerated relative to other elements to help improve understanding of various examples of the present invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the above disclosure, reference has been made to the accompanying drawings, which form a part hereof, and in which are shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, such feature, structure, or characteristic may be used in connection with other embodiments whether or not explicitly described. The particular features, structures or characteristics may be combined in any suitable combination and/or sub-combinations in one or more embodiments or examples. It is appreciated that the figures provided herewith are for explanation purposes to persons ordinarily skilled in the art.

As used herein, "adjacent" refers to near or close sufficient to achieve a desired effect. Although direct contact is common, adjacent can broadly allow for spaced apart features.

As used herein, the singular forms "a," and, "the" include plural referents unless the context clearly dictates otherwise.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be such as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a number or numerical range endpoint by providing that a given value may be "a little above" or "a little below" the number or endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Dimensions, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

Turning now to FIG. 1, a pump dispenser 10 is shown. Such a pump dispenser 10 may be provided with toiletries such as lotion, hydrating cream, etc. and is used to dispense the product for use. The pump dispenser 10 includes a bottle 14 which holds product 18. A pump unit 22 dispenses product 18 from the bottle 14. The pump unit 22 includes a cap 26 which attaches to threads on top of the bottle 14 to close the bottle 14, a plunger assembly 30, a dispensing nozzle 34, a pump 38, and a supply tube 42. Internally, the pumping unit 22 includes a spring disposed between the plunger 30 and the body of the pump 38 and check valves so that cycling the plunger 30 draws product 18 into the supply tube 42, through the pump 38, and out of the dispensing nozzle 34.

The pump dispenser 10 is shown with a few ounces of product 18 remaining in the bottle 14. The illustrated product 18 is a lotion or moisturizing cream. These products 18 are typically non-Newtonian fluids which behave as Bingham plastics that do not flow until a sufficient pressure is applied to them. Accordingly, most do not self-level under the force of gravity. Additionally, bottles 14 are manufactured with a concave indentation 46 at the bottom which forms a convex projection in the interior of the bottle 14. This indentation 46 ensures that the bottle 14 does not rock while resting on a flat surface. The supply tube 42 is spaced above the indentation 46. When the level of the product 18 is reduced, dispensing the product 18 results in withdrawal of the product 18 immediately around the supply tube 42 while leaving product around the perimeter of the bottle 14. Once air enters the supply tube 42, the product 18 typically remains as shown and ceases to be dispensed. This often occurs with about one to three ounces of product 18 remaining the bottle 14. For inexpensive lotions in a larger bottle, about two or three ounces of the product 18 may remain. This may be about five to ten percent of the bottle. More expensive designer lotions and creams are often sold in smaller quantities and smaller bottles 14. For these products, one ounce of product 18 remaining in the bottle may be about ten to twenty percent of the product. Waste of this product can be a significant economic cost while use of the product is now inconvenient and dissatisfying.

Figure 2:
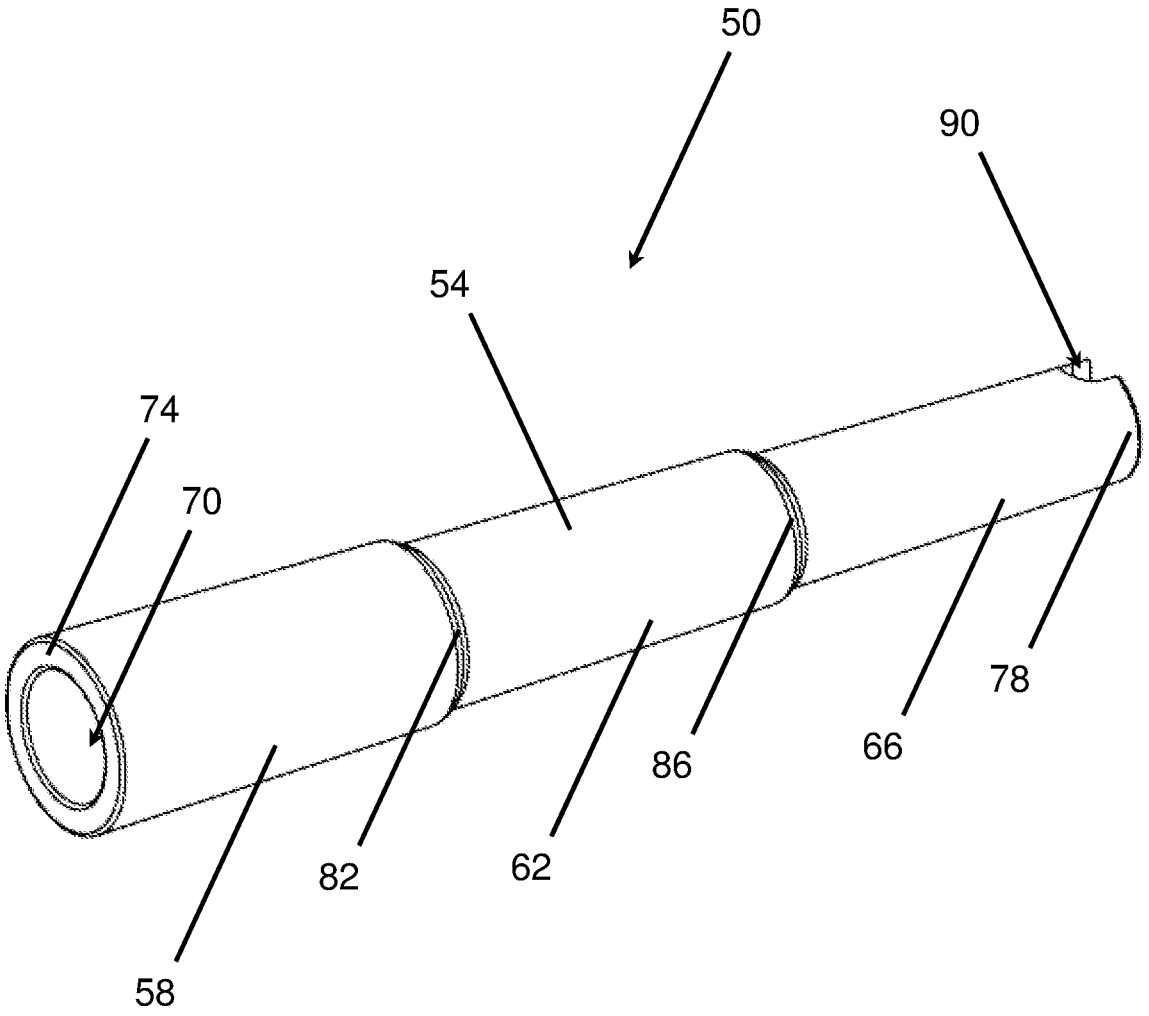
FIG. 2 is a perspective drawing of an intake boot.
Figure 3:
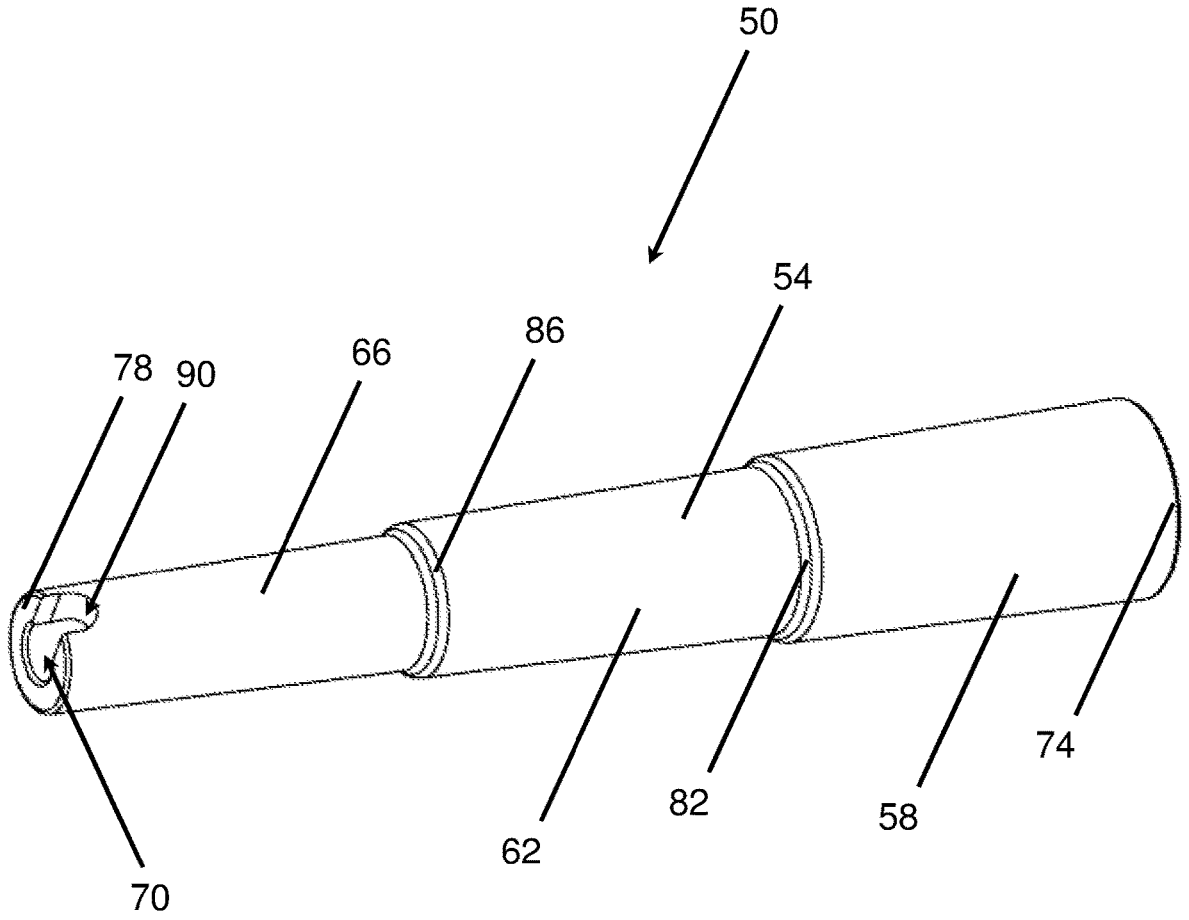
FIG. 3 is a perspective drawing of the intake boot.
Figure 4:
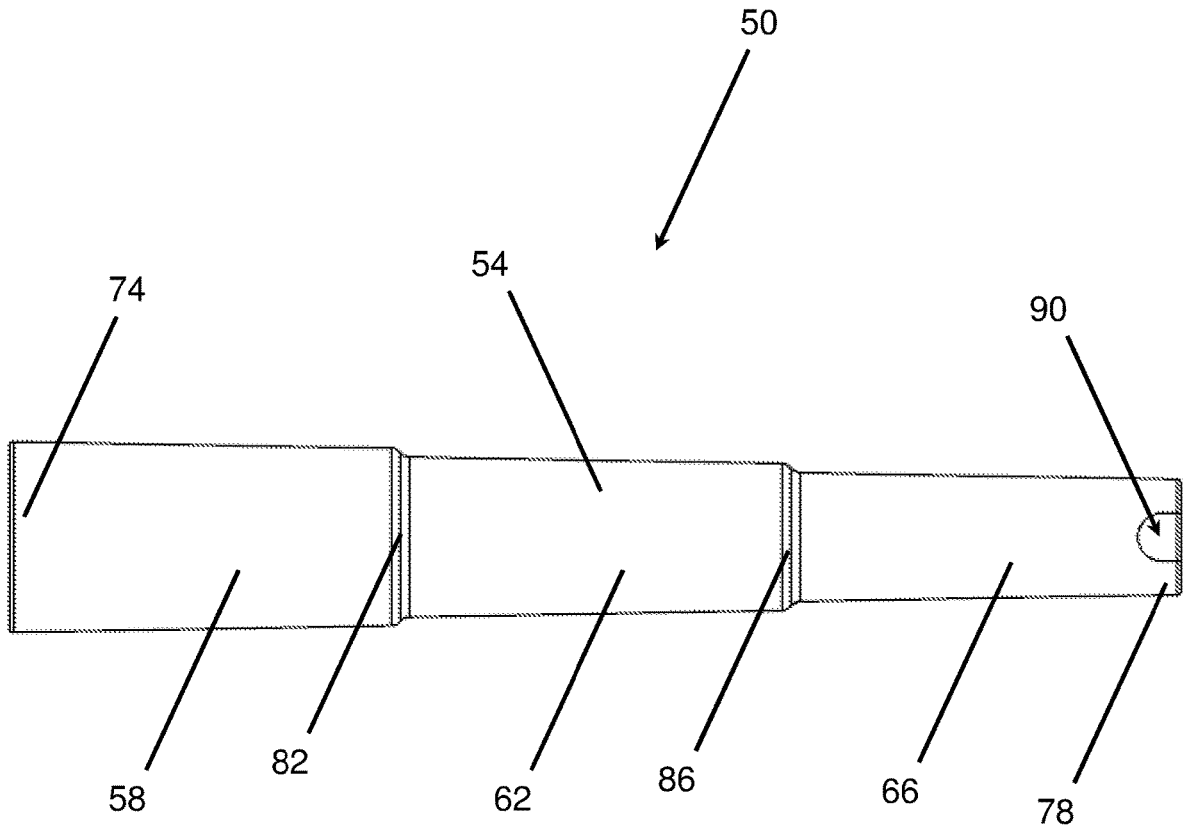
FIG. 4 is top view drawing of the intake boot.
Figure 5:
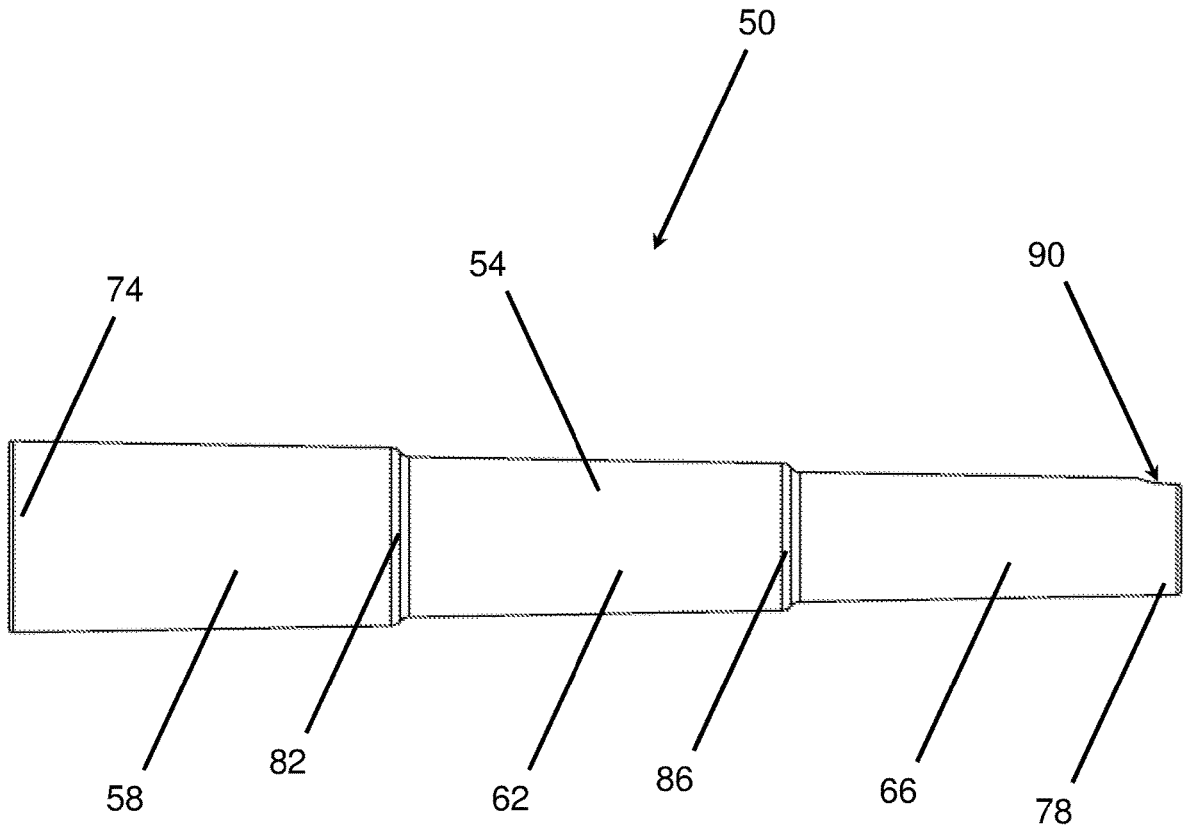
FIG. 5 is a side view drawing of the intake boot.
Figure 6:
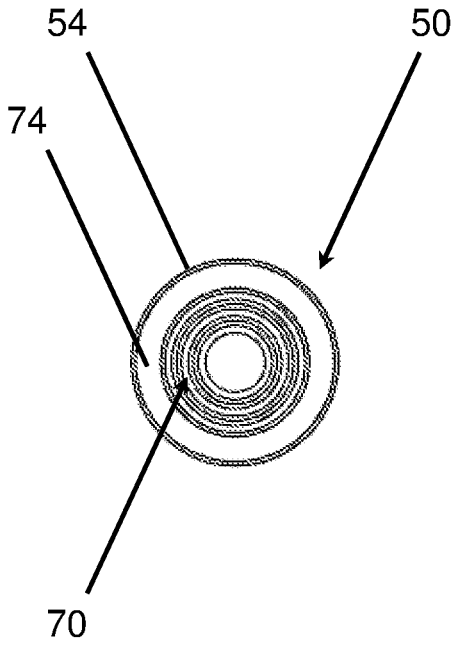
FIG. 6 is a drawing of the proximal end of the intake boot.
Figure 7:
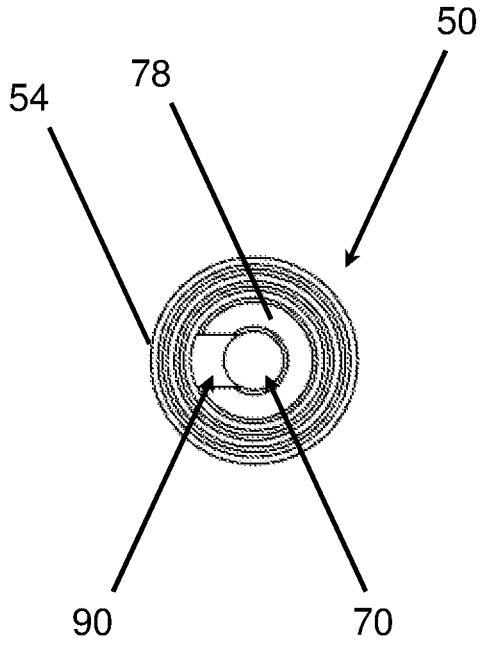
FIG. 7 is a drawing of the distal end of the intake boot.
Figure 8:
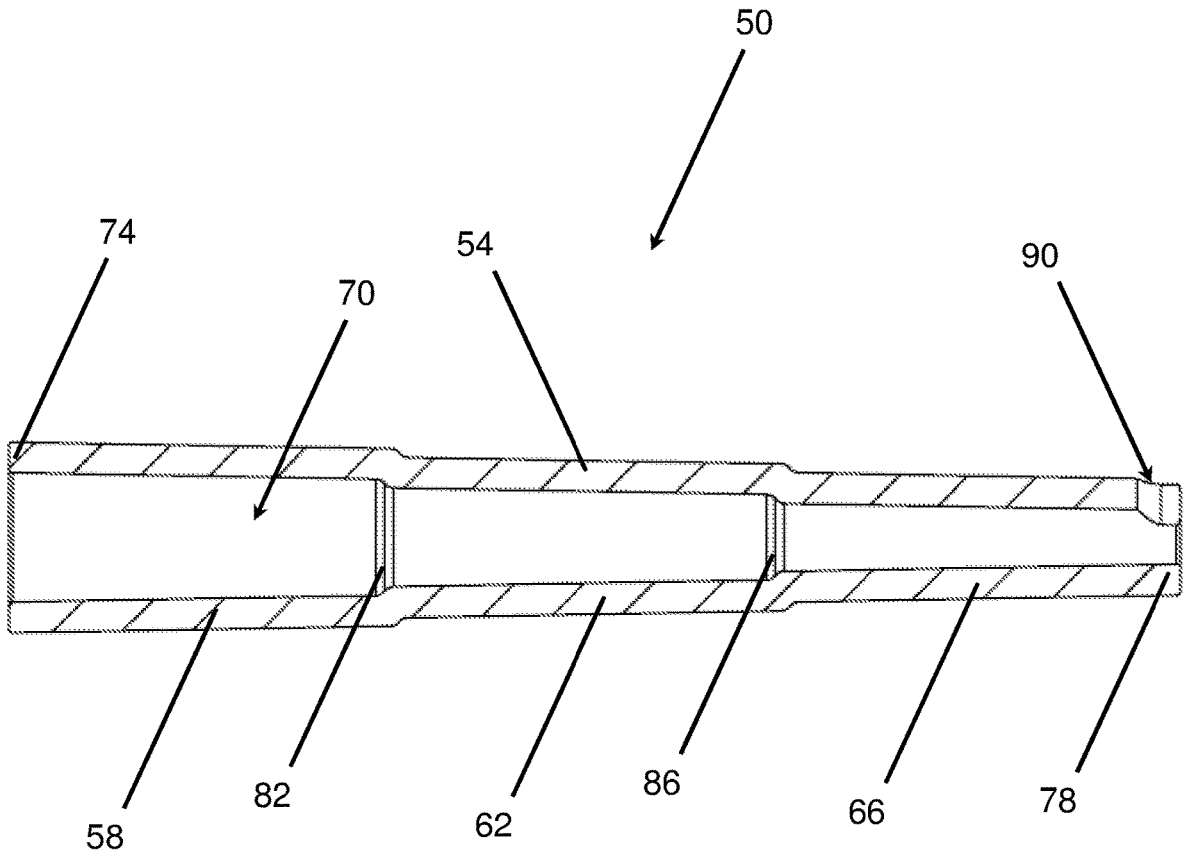
FIG. 8 is a cross-sectional drawing of the intake boot.

Referring now to FIGS. 2 through 8, an intake boot 50 for pump dispenser supply tubes 42 is shown. FIGS. 2 and 3 show perspective views of the intake boot 50. FIG. 4 shows a top view of the intake boot 50. FIG. 5 shows a side view of the intake boot 50. FIGS. 6 and 7 show end views of the intake boot 50. FIG. 8 shows a drawing of the intake boot 50 installed in a pump dispenser 10.

The intake boot 50 includes a body 54 with a first body section 58, a second body section 62, and a third body section 66. A lumen 70 extends lengthwise through the body 54 and is open to each end of the body. The body 54 changes diameter along its length. The proximal end 74 of the body is a larger diameter than the distal end of the body 78. The lumen 70 also changes diameter along its length and the proximal end of the lumen 70 is a larger diameter than the distal end of the lumen 70. The body 54 includes a first step 82 between the first body section 58 and the second body section 62 and a second step 86 between the second body section 62 and the third body section 66. The body 54 and the lumen change diameter at the steps 82, 86; reducing diameter towards the distal end of the body 54.

The body 54 and the lumen 70 taper along their length. The first body section 58 is larger in diameter at its proximal end and smaller in diameter at its distal end. The second body section 62 is larger in diameter at its proximal end and smaller in diameter at its distal end. The third body section 66 is larger in diameter at its proximal end and smaller in diameter at its distal end. The section of the lumen 70 through the first body section 58 is larger in diameter at its proximal end and smaller in diameter at its distal end. The section of the lumen 70 through the second body section 62 is larger in diameter at its proximal end and smaller in diameter at its distal end. The section of the lumen 70 through the third body section 66 is larger in diameter at its proximal end and smaller in diameter at its distal end.

FIG. 3 shows better illustrates the distal end 78 of the intake boot 50 and illustrates how the distal end of the lumen 70 is smaller than the proximal end of the lumen 70. The distal end 78 of the intake boot 50 includes a side port 90 which is a passage cut through the side wall of the distal body section 66 at the distal end 78 of the body 54. The side port 90 is connected to the distal end of the lumen 70. As shown in FIG. 4, the side port 90 may be semi-circular shaped cutout in the sidewall of the body.

FIG. 8 shows a cross sectional view of the intake boot 50. The lumen 70 extends through the length of the intake boot body 54 and forms openings in the proximal end 74 and distal end 78 of the intake boot 54. The example intake boot 50 is about 75 mm long and has a proximal end 74 which is about 13 mm in diameter. The larger diameter of the body 54 at the first step 82 is about 12 mm with the smaller diameter at the first step being about 11 mm in diameter. The larger diameter of the body 54 at the second step 86 is about 10 mm with the smaller diameter at the second step being about 9 mm in diameter. The outer diameter of the distal end 78 of the body 54 is about 8 mm in diameter. The body 54 thus tapers about 1 mm from the proximal end to the first step 82, steps down about 1 mm at the first step 82, tapers down about 1 mm between the first step 82 and the second step 86, steps down about 1 mm at the second step 86, and tapers down about 1 mm between the second step 86 and the distal end 78. The walls of the body 54 are about 2 mm thick and follow the taper and step shape of the outside of the body 54. Accordingly, the lumen 70 is about 9 mm in diameter at the proximal end 74, tapers down by about 1 mm to about 8 mm at the first step 82, steps down by about 1 mm to about 7 mm at the first step 82, tapers down by about 1 mm to about 6 mm between the first step 82 and the second step 86, steps down by about 1 mm to about 5 mm at the second step 86, and tapers down by about 1 mm to about 4 mm between the step and the distal end 78. The lumen opening at the distal end 78 is about 4 mm in diameter. The side port 90 formed at the distal end 78 of the body 54 is between about 3 and about 4 mm wide and long. The side port 90 extends through the sidewall and connects to the lumen 70.

The intake boot 50 is preferably formed from an elastomer such as a thermoplastic elastomer. The intake boot 50 may be formed from santoprene. The intake boot 50 is flexible and the example intake boot 50 is formed from a material having a Shore A hardness which is between about 40 and about 60, and preferably having a Shore A hardness of about 60.

Figure 9:
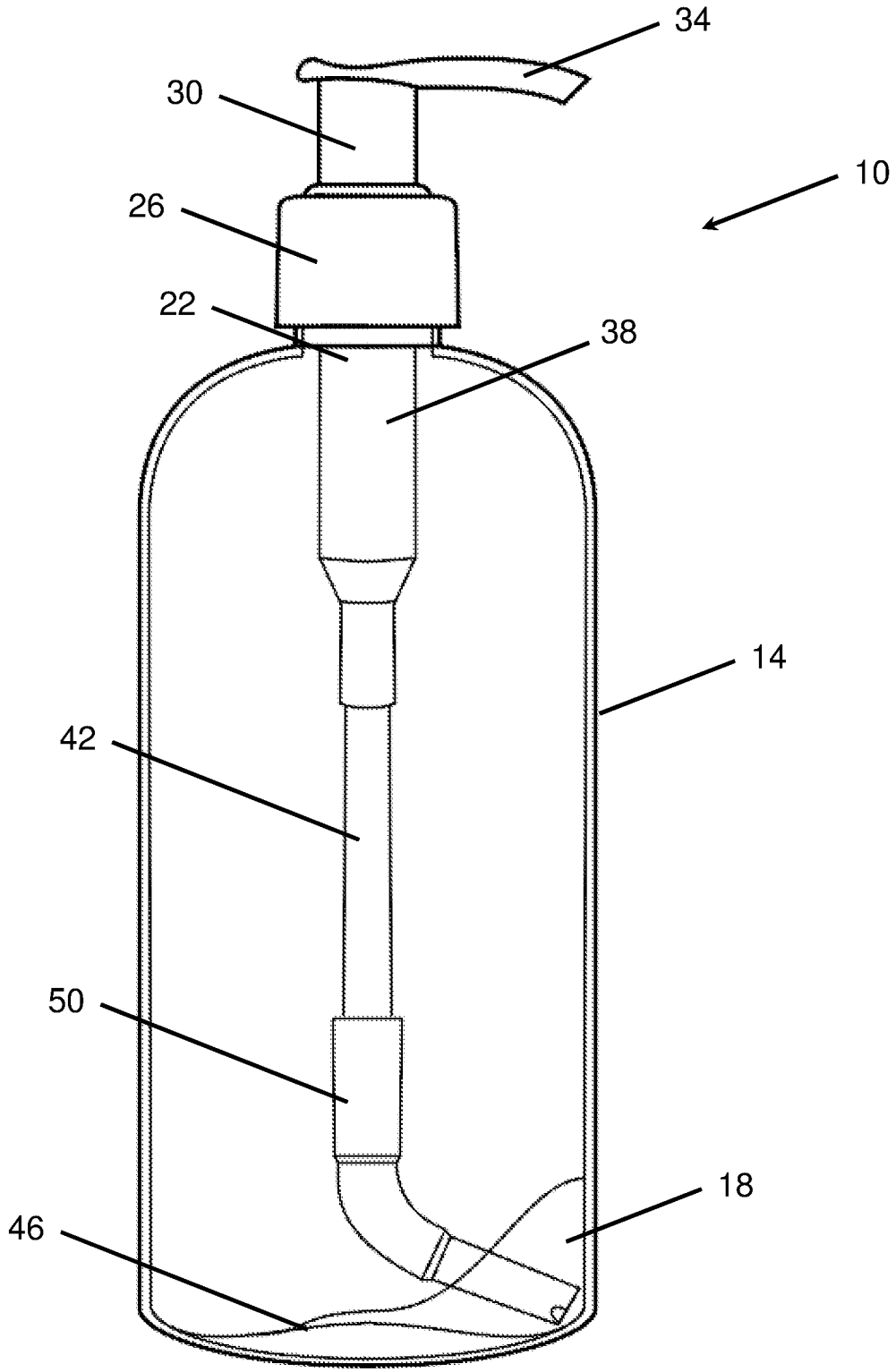
FIG. 9 is a drawing of the intake boot attached to the bottle of FIG. 1.

FIG. 9 shows a drawing of the intake boot 50 installed in a pump dispenser 10. The intake boot 50 fits onto the bottom end of the supply tube 42. In some cases, about 1 or 2 cm will need to be cut off of the end of the supply tube 42 to provide space for the intake boot 50. The tapered and stepped diameter of the lumen 70 accommodates most of the common supply tubes 42 used for toiletries. In the example shown, the supply tube 42 is received within the first section of the lumen 70. Smaller supply tubes will fit within the second or third section of the lumen 70. In a smaller bottle, the intake boot 50 may be cut to remove the proximal end 70 and first body section 58. In fitting the intake boot 50 to the supply tube, the supply tube 42 is cut so that the intake boot 50 would extend beyond the bottom of the bottle 14. The portion of the intake boot 50 which extends beyond the supply tube 42 curves towards the side of the bottle 14. The convex projection 46 formed in the bottom of the bottle interior tends to naturally push the intake boot 50 towards the side of the bottle 14 as the pump unit 22 is inserted into the bottle 14. The tapered and/or stepped profile of the intake boot 50 provides increasing flexibility towards the distal end 78 of the intake boot 50 and will curve well to accommodate the bottle 14. The intake boot 50 is stiff enough to be positioned in the corner of the bottle 14 and remain there during use while still being flexible enough to adapt to different bottle dimensions and bend without kinking or problems.

In use, the distal end 78 of the intake boot 50 remains in the corner of the bottle 14. The product 18 remaining in the bottle 14 can be easily moved into this corner of the bottle 14 by tapping the bottle against a surface. In contrast, this product is not easily extracted by a simple supply tube 42 because the supply tube is positioned above the convex projection formed in the bottom of the bottle 14 and tapping the bottle 14 will not position the product 18 in a position where it is retrieved by the supply tube. The side port 90 helps draw product into the intake boot 50 and ensures that the lumen 70 is not blocked against the side of a bottle 14. The intake boot 50 allows a user to dispense nearly all of a thick fluid such as a lotion or cream from a pump dispenser easily. Product waste is eliminated and the user experience is improved.

The above description of illustrated examples of the present invention, including what is described in the Abstract, is not intended to be exhaustive or to be limiting to the precise forms disclosed. While specific examples of the invention are described herein for illustrative purposes, various equivalent modifications are possible without departing from the broader scope of the present claims. Indeed, it is appreciated that specific example dimensions, materials, etc., are provided for explanation purposes and that other values may also be employed in other examples in accordance with the teachings of the present invention.

What is claimed is:

1. An intake boot for a pump dispenser supply tube comprising:

a body formed from an elastomeric material;

a proximal end;

a proximal supply tube attachment section disposed adjacent the proximal end;

a distal end;

a lumen extending through the body from the proximal end to the distal end;

wherein the lumen tapers and reduces in size along an elongate section of the lumen located distally of the proximal supply tube attachment section such that a proximal lumen opening is larger than a distal lumen opening;

wherein, in use, the intake boot is attached to a household toiletry pump dispenser comprising a bottle, a pump unit attached to the bottle, the pump unit comprising a pump, a dispensing nozzle, and a supply tube which extends into the bottle from the pump;

wherein, in use, a proximal section of the intake boot is disposed over a distal section of the supply tube to attach the intake boot to the supply tube;

wherein, in use, a distal section of the intake boot contacts a bottom of the bottle and is bent towards a bottom corner of the bottle.

2. The intake boot of claim 1, wherein the lumen reduces in size along a length of the lumen extending between the proximal end and the distal end.

3. The intake boot of claim 1, wherein, in use, the intake boot contacts the bottom of the bottle and is bent elastically towards the bottom corner of the bottle.

4. The intake boot of claim 1, wherein the intake boot further comprises a side port passage formed at the distal end of the body, and wherein the side port passage extends through a sidewall of the body and connects to the lumen.

5. The intake boot of claim 1, wherein the intake boot body has a circular cross section and the lumen has a circular cross section.

6. The intake boot of claim 1, wherein an elongate section of an exterior surface of the intake boot body tapers from the proximal end to the distal end so that the distal end is smaller than the proximal end.

7. The intake boot of claim 1, wherein the intake boot body includes a first step between the proximal end and the distal end which reduces a diameter of a portion of the body distal to the first step.

8. The intake boot of claim 7, wherein the intake boot body includes a second step between the first step and the distal end which reduces a diameter of a portion of the body distal to the second step.

9. The intake boot of claim 1, wherein the body tapers to reduce size between the proximal end and a first step located between the proximal end and the distal end of the body, wherein the body reduces in size at the first step so that a size of a portion of the body distal to the first step is smaller than a size proximal of the first step, wherein the body tapers to reduce size between the first step and a second step located between the first step and the distal end of the body, wherein the body reduces in size at the second step so that a size of a portion of the body distal to the second step is smaller than a size of the body proximal of the first step, and wherein the body tapers to reduce size between the second step and the distal end of the body.

10. An intake boot for a household pump dispenser supply tube comprising:

an elongate body formed from an elastomeric material;

a proximal end;

a distal end;

a lumen extending through the body from the proximal end to the distal end;

wherein an elongate section of the lumen tapers and reduces in size from the proximal end to the distal end;

wherein the intake boot is configured for attachment to a household pump dispenser comprising a bottle, a pump unit attached to the bottle, the pump unit comprising a pump, a dispensing nozzle, and a supply tube which extends into the bottle from the pump such that a proximal section of the intake boot is disposed over a distal section of the supply tube to attach the intake boot to the supply tube and such that a distal section of the intake boot contacts a bottom of the bottle and is bent towards a bottom corner of the bottle.

11. The intake boot of claim 10, further comprising a side port passage formed at the distal end of the body which extends through a sidewall of the body and connects to the lumen.

12. The intake boot of claim 10, wherein the lumen reduces in size along a length of the lumen extending between the proximal end of the body and the distal end of the body such that a proximal lumen opening is larger than a distal lumen opening.

13. The intake boot of claim 10, wherein, in use, the intake boot contacts the bottom of the bottle and is bent elastically towards the bottom corner of the bottle when attached to the supply tube.

14. The intake boot of claim 10, wherein an elongate section of an exterior surface of the intake boot body tapers from the proximal end to the distal end so that the distal end is smaller than the proximal end.

15. The intake boot of claim 10, wherein the intake boot body includes a first step between the proximal end and the distal end which reduces a diameter of a portion of the body distal to the first step and a second step between the first step and the distal end which reduces a diameter of a portion of the body distal to the second step.

16. The intake boot of claim 10, wherein the body tapers to reduce size between the proximal end and a first step located between the proximal end and the distal end of the body, wherein the body reduces in size at the first step so that a size of a portion of the body distal to the first step is smaller than a size proximal of the first step, wherein the body tapers to reduce size between the first step and a second step located between the first step and the distal end of the body, wherein the body reduces in size at the second step so that a size of a portion of the body distal to the second step is smaller than a size of the body proximal of the first step, and wherein the body tapers to reduce size between the second step and the distal end of the body.

17. The intake boot of claim 10, wherein the intake boot is unitary elastomeric material.

18. An intake boot for a household pump dispenser supply tube comprising:

an elongate body formed from a flexible and elastomeric material;

a proximal end;

a distal end which is smaller than the proximal end;

a lumen extending through the body from the proximal end to the distal end;

wherein the intake boot body includes a first step between the proximal end and the distal end which reduces a diameter of a portion of the body distal to the first step;

wherein the intake boot body includes a second step between the first step and the distal end which reduces a diameter of a portion of the body distal to the second step; and wherein the intake boot is configured for attachment to a household pump dispenser comprising a bottle, a pump unit attached to the bottle, the pump unit comprising a pump, a dispensing nozzle, and a supply tube which extends into the bottle from the pump such that a proximal section of the intake boot is disposed over a distal section of the supply tube.

19. The intake boot of claim 18, wherein an elongate section of the lumen tapers and reduces in size from the proximal end to the distal end.

20. The intake boot of claim 18, wherein an elongate section of an exterior surface of the intake boot body tapers in size and the distal end of the body is smaller than the proximal end of the body.

* * * * *